US005876026A

United States Patent [19]

Chen

[11] Patent Number: 5,876,026

[45] Date of Patent: Mar. 2, 1999

[54] CLAMP PLIERS

[76] Inventor: Jenn-Hwang Chen, 58, Ma Yuan West St., Taichung, Taiwan

[21] Appl. No.: 729,859

[22] Filed: Oct. 15, 1996

[51] Int. Cl.[6] ..... B25B 1/00

[52] U.S. Cl. ..... 269/156; 269/238; 269/902; 269/275; 269/138

[58] Field of Search ..... 81/302, 413, 421, 81/424, 424.5, 427; 269/152, 156, 237, 238, 265, 269, 271, 279, 280, 281, 283, 260, 262, 263, 1, 2, 902, 254 R, 254 CS, 259, 261, 264, 224, 275; 29/268

[56] References Cited

U.S. PATENT DOCUMENTS 2,501,238 3/1950 Sarsgard et al. ..... 269/224
3,061,357 10/1962 Wright ..... 81/424
3,512,794 5/1970 Lohman ..... 269/138
3,779,108 12/1973 Reiter ..... 269/275

*Primary Examiner*—Robert C. Watson

[57] ABSTRACT

A pair of clamp pliers comprises an upper clip plate, a lower clip plate, a torsion spring disposed between the upper clip plate and the lower clip plate, a pivot pin passing through the torsion spring to fasten the upper clip plate and the lower clip plate together, a first recess hole formed on a front portion of the upper clip plate to receive a first compression spring and an upper mount, and a second recess hole formed on a front portion of the lower clip plate to receive a second compression spring and a lower mount.

5 Claims, 3 Drawing Sheets

CLAMP PLIERS

BACKGROUND OF THE INVENTION

The invention relates to a pair of clamp pliers. More particularly, the invention relates to a clamp device with a strong clamping force.

A pair of conventional clamp pliers has an upper arm, a lower arm, a torsion spring disposed between the upper arm and the lower arm, and a pivot pin passing through the torsion spring to fasten the upper arm and the lower arm together. However, the pair of conventional clamp pliers can clamp a round article loosely.

SUMMARY OF THE INVENTION

An object of the invention is to provide a pair of clamp pliers which has a strong clamping force.

Accordingly, a pair of clamp pliers comprises an upper clip plate, a lower clip plate coupled with the upper clip plate, a torsion spring disposed between the upper clip plate and the lower clip plate, a pivot pin passing through the torsion spring to fasten the upper clip plate and the lower clip plate together, a first recess hole formed on a front portion of the upper clip plate to receive a first compression spring and an upper mount, and a second recess hole formed on a front portion of the lower clip plate to receive a second compression spring and a lower mount. The upper clip plate has a first front end. A first V-shaped groove is formed on a first front end of the upper clip plate. The lower clip plate has a second front end. A second V-shaped groove is formed on a second front end of the lower clip plate. The upper mount has a first main block, a first post disposed on the first main block, a first notch formed on the first main block, and a first oblong slot formed on the first post. A first compression spring is inserted in the first recess hole. The first post is inserted in the first recess hole to compress the first compression spring. A first bolt passes through the first oblong slot to fasten the upper mount and the upper clip plate together. The lower mount has a second main block, a second post disposed on the second main block, a second notch formed on the second main block, and a second oblong slot formed on the second post. A second compression spring is inserted in the second recess hole. The second post is inserted in the second recess hole to compress the second compression spring. A second bolt passes through the second oblong slot to fasten the lower mount and the lower clip plate together.

DETAILED DESCRIPTION OF THE INVENTION

Figure 1:
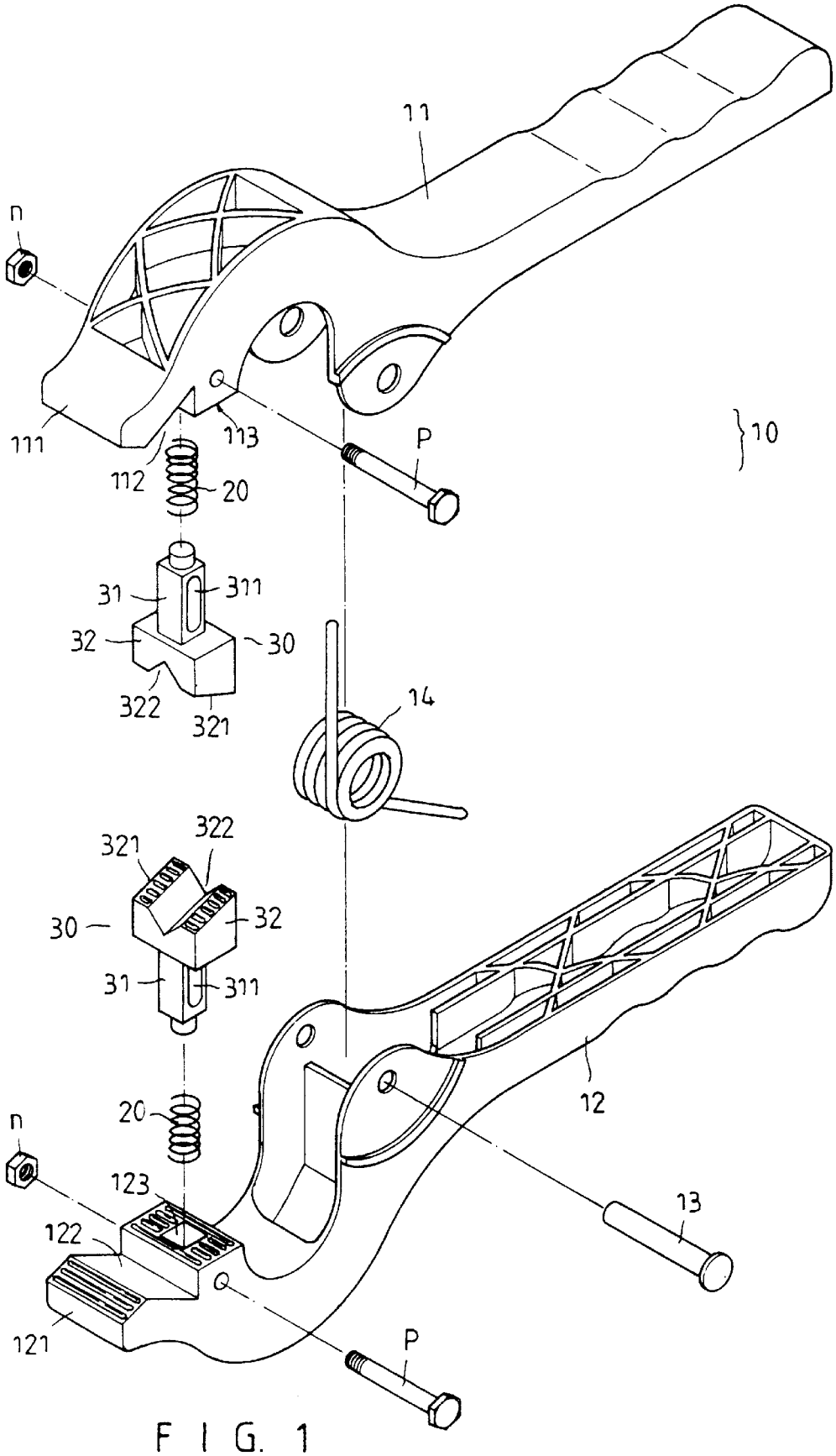
FIG. 1 is a perspective exploded view of a pair of clamp pliers of a preferred embodiment in accordance with the invention.

Referring to FIGS. 1 to 4, a pair of clamp pliers 10 comprises an upper clip plate 11, a lower clip plate 12 coupled with the upper clip plate 11, a torsion spring 14 disposed between the upper clip plate 11 and the lower clip plate 12, a pivot pin 13 passing through the torsion spring 14 to fasten the upper clip plate 11 and the lower clip plate 12 together, a first recess hole 113 formed on a front portion of the upper clip plate 11 to receive a first compression spring 20 and an upper mount 30, and a second recess hole 123 formed on a front portion of the lower clip plate 12 to receive a second compression spring 20 and a lower mount 30.

The upper clip plate 11 has a first front end 111. A first V-shaped groove 112 is formed on a first front end 111 of the upper clip plate 11.

The lower clip plate 12 has a second front end 121. A second V-shaped groove 122 is formed on a second front end 121 of the lower clip plate 12. The upper mount 30 has a first main block 32, a first post 31 disposed on the first main block 32, a first notch 322 formed on the first main block 32, and a first oblong slot 311 formed on the first post 31. A first compression spring 20 is inserted in the first recess hole 113. The first post 31 is inserted in the first recess hole 113 to compress the first compression spring 20. A first bolt p passes through the first oblong slot 311 to fasten the upper mount 30 and the upper clip plate 11 together. The first bolt p is screwed by a first nut n.

The lower mount 30 has a second main block 32, a second post 31 disposed on the second main block 32, a second notch 322 formed on the second main block 32, and a second oblong slot 311 formed on the second post 31, A second compression spring 20 is inserted in the second recess hole 123. The second post 31 is inserted in the second recess hole 123 to compress the second compression spring 20. A second bolt p passes through the second oblong slot 311 to fasten the lower mount 30 and the lower clip plate 12 together. The second bolt p is screwed by a second nut n.

Figure 2:
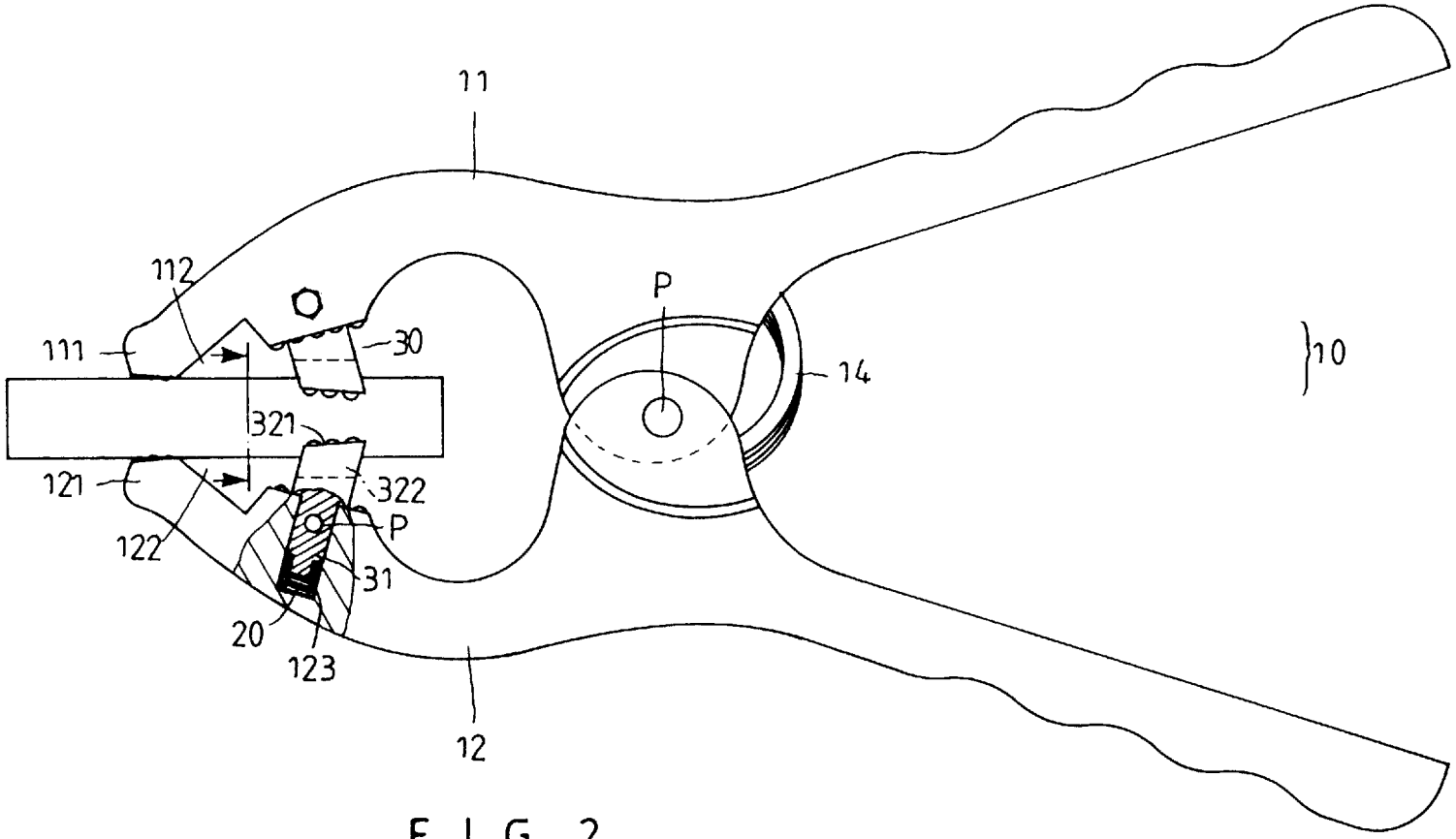
FIGS. 2 to 4 are elevational views illustrating the operations of the pair of clamp pliers.
Figure 4:
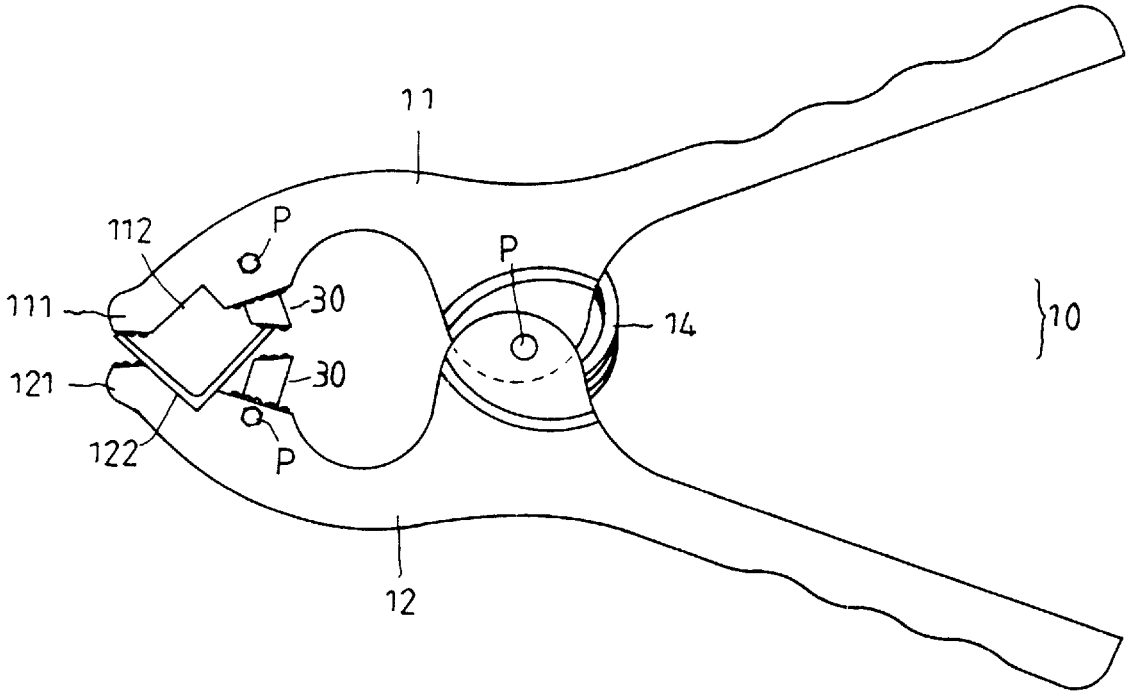
Figure 3:
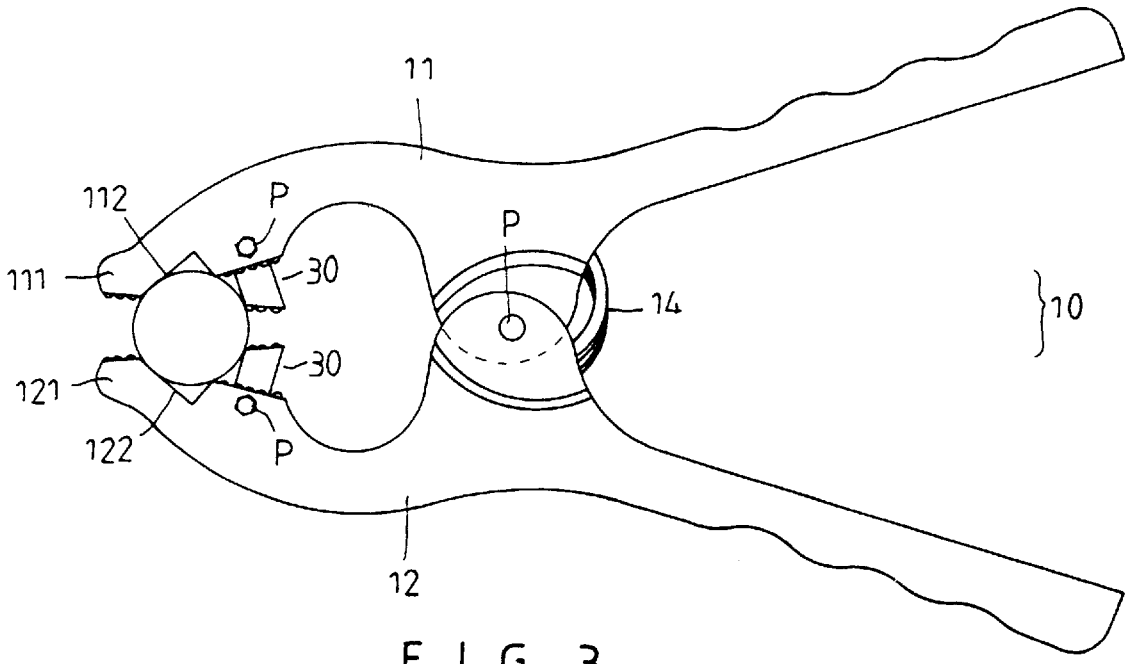

Referring to FIG. 2, the first front end 111 and the second front end 121 clamps a front portion of a rod. The upper and lower main blocks 32 clamp a rear portion of the rod. Therefore, the rod can be clamped tightly. Referring to FIGS. 3 and 4, the pair of clamp pliers 10 can clamp various types of articles with a strong clamping force.

The invention is not limited to the above embodiment but various modification thereof may be made. Further, various changes in form and detail may be made without departing from the scope of the invention.

I claim:

1. A pair of clamp pliers comprises:

an upper clip plate, a lower clip plate coupled with the upper clip plate, a torsion spring disposed between the upper clip plate and the lower clip plate, a pivot pin passing through the torsion spring to fasten the upper clip plate and the lower clip plate together, a first recess hole formed on a front portion of the upper clip plate, the upper clip plate having a first front end, a first V-shaped groove formed on the first front end of the upper clip plate, an upper mount having a first main block, a first post disposed on the first main block, a first notch formed on the first main block, and a first oblong slot formed on the first post, a first elastic element inserted in the first recess hole, the first post inserted in the first recess hole to compress the first elastic element, a first fastener passing through the first oblong slot to fasten the upper mount and the upper clip plate together, a second recess hole formed on a front portion of the lower clip plate, the lower clip plate having a second front end, a second V-shaped groove formed on the second front end of the lower clip plate, a lower mount having a second main block, a second post disposed on the second main block, a second notch formed on the second main block, and a second oblong slot formed on the second post, a second elastic element inserted in the second recess hole, the second post inserted in the second recess hole to compress the second elastic element, and a second fastener passing through the second oblong slot to fasten the lower mount and the lower clip plate together.

2. A pair of clamp pliers as claimed in claim 1, wherein said first fastener is a bolt.

3. A pair of clamp pliers as claimed in claim 1, wherein said second fastener is a bolt.

4. A pair of clamp pliers as claimed in claim 1, wherein said first elastic element is a compression spring.

5. A pair of clamp pliers as claimed in claim 1, wherein said second elastic element is a compression spring.

* * * * *